US008158323B2

(12) United States Patent
Aoki et al.

(10) Patent No.: US 8,158,323 B2
(45) Date of Patent: Apr. 17, 2012

(54) METHOD OF MANUFACTURING TONER AND TONER PRODUCED BY THE METHOD

(75) Inventors: Mitsuo Aoki, Numazu (JP); Satoshi Ogawa, Nara (JP)

(73) Assignee: Ricoh Company Limited, Tokyo (JP)

( * ) Notice: Subject to any disclaimer, the term of this patent is extended or adjusted under 35 U.S.C. 154(b) by 597 days.

(21) Appl. No.: 12/332,549

(22) Filed: Dec. 11, 2008

(65) Prior Publication Data

US 2009/0155710 A1 Jun. 18, 2009

(30) Foreign Application Priority Data

Dec. 14, 2007 (JP) ..... 2007-322859

(51) Int. Cl.
*G03G 9/08* (2006.01)

(52) U.S. Cl. ..... 430/137.2; 430/137.18

(58) Field of Classification Search ..... 430/137.18, 430/137.2

See application file for complete search history.

(56) References Cited

U.S. PATENT DOCUMENTS

| | | | | |
|---|---|---|---|---|
| 6,232,030 | B1 * | 5/2001 | Otani et al. | 430/137.2 |
| 2005/0095523 | A1 * | 5/2005 | Shimokusa et al. | 430/108.8 |
| 2005/0130052 | A1 * | 6/2005 | Tsunemi | 430/108.4 |
| 2009/0053639 | A1 * | 2/2009 | Shimmura | 430/106.2 |
| 2010/0074659 | A1 * | 3/2010 | Shimmura | 399/301 |

FOREIGN PATENT DOCUMENTS

| | | |
|---|---|---|
| CN | 1637631 A | 7/2005 |
| JP | 2993624 | 10/1999 |
| JP | 3010326 | 12/1999 |
| JP | 2002-278160 | 9/2002 |
| JP | 3366576 | 11/2002 |
| JP | 3603709 | 10/2004 |
| JP | 2004-317872 | 11/2004 |
| JP | 2004-341129 | 12/2004 |
| JP | 2005-234370 | 9/2005 |
| JP | 2005-345733 | 12/2005 |
| JP | 3801458 | 5/2006 |
| JP | 3861978 | 10/2006 |
| JP | 2006-305982 | 11/2006 |
| JP | 2007-3799 | 1/2007 |

OTHER PUBLICATIONS

Office Action issued Sep. 21, 2011, in Chinese Patent Application No. 200810183761.X.

* cited by examiner

*Primary Examiner* — Janis L Dote
(74) *Attorney, Agent, or Firm* — Oblon, Spivak, McClelland, Maier & Neustadt, L.L.P.

(57) ABSTRACT

A method of manufacturing toner including the steps of preparing a preliminary mixture by mixing a colorant and a release agent; preparing a raw material mixture by mixing the preliminary mixture with a binder resin and other raw materials; melt-kneading the raw material mixture using an open system roll type kneader; pulverizing the melt-kneaded raw material mixture into fine particles; and classifying the fine particles to prepare a toner.

2 Claims, 1 Drawing Sheet

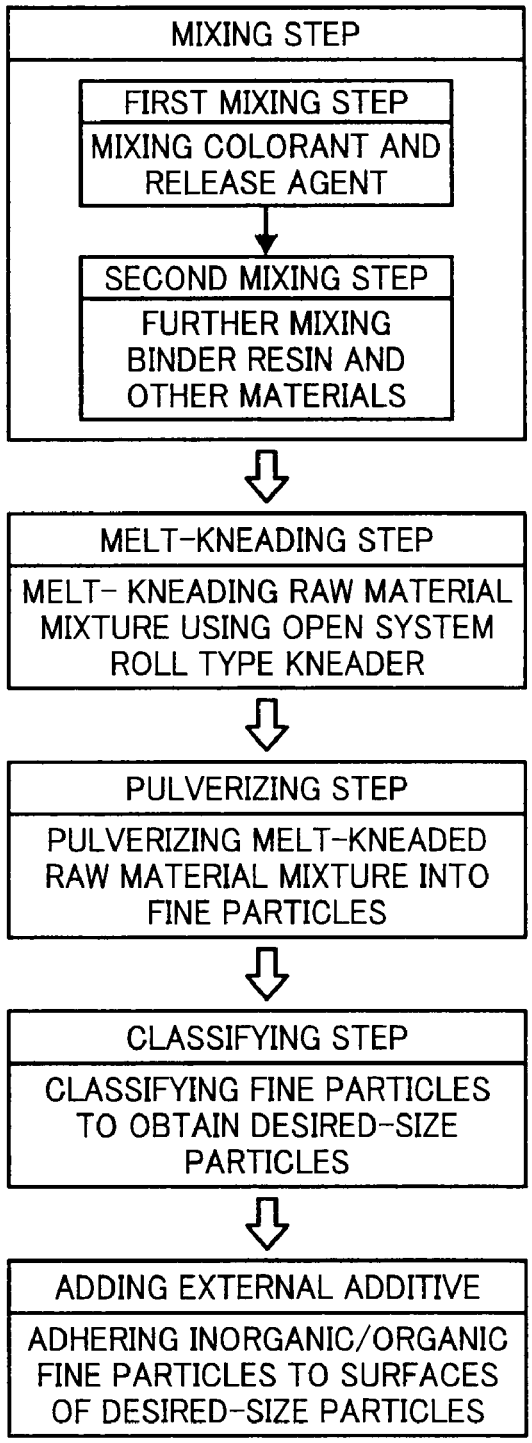
MIXING STEP
FIRST MIXING STEP
MIXING COLORANT AND RELEASE AGENT
SECOND MIXING STEP
FURTHER MIXING BINDER RESIN AND OTHER MATERIALS
MELT-KNEADING STEP
MELT- KNEADING RAW MATERIAL MIXTURE USING OPEN SYSTEM ROLL TYPE KNEADER
PULVERIZING STEP
PULVERIZING MELT-KNEADED RAW MATERIAL MIXTURE INTO FINE PARTICLES
CLASSIFYING STEP
CLASSIFYING FINE PARTICLES TO OBTAIN DESIRED-SIZE PARTICLES
ADDING EXTERNAL ADDITIVE
ADHERING INORGANIC/ORGANIC FINE PARTICLES TO SURFACES OF DESIRED-SIZE PARTICLES

METHOD OF MANUFACTURING TONER AND TONER PRODUCED BY THE METHOD

BACKGROUND OF THE INVENTION

1. Field of the Invention

The present invention relates to a method of manufacturing toner for use in electrophotography and a toner manufactured by the method.

2. Discussion of the Background

A series of electrophotographic image forming processes include, in rough order, a charging process, an irradiating process, a developing process, a transfer process, a cleaning process, and a fixing process. In the charging process, a surface of a photoreceptor is evenly charged. In the irradiating process, the charged surface of the photoreceptor is irradiated with a light beam to form an electrostatic latent image thereon. In the developing process, a developer such as a toner is adhered to the electrostatic latent image formed on the surface of the photoreceptor to form a toner image. In the transfer process, the toner image transferred onto a recording medium is fixed thereon by application of heat and/or pressure. In the cleaning process, residual toner particles that remain on the surface of the photoreceptor without being transferred onto the recording medium are removed. Thus, a resultant image is formed on the recording medium.

The toner used for the developing process typically includes a binder resin, a colorant such as carbon black, and a release agent such as wax. The binder resin has a function of binding the colorant and the release agent that cannot be formed into a toner alone or fixed on a recording medium by themselves. The colorant is necessary for forming a full-color image, and organic pigments and dyes are generally used therefor. The release agent functions as an offset inhibitor when a fixing member such as a heat roller contacts a toner image which is transferred onto a recording medium in the fixing process.

In accordance with recent speed-up of electrophotographic image forming processes, in other words, shortening of a processing time for recording an image on a sheet of paper, a time of contact of a fixing member with the paper is also shortened. As a consequence, a temperature range of the fixing member within which an offset problem does not occur (hereinafter referred to as a non-offset temperature range) is narrowed. The offset problem here refers to an undesirable phenomenon in which part of a fused toner image is adhered to a surface of the fixing member, and re-transferred onto an undesired portion of the recording medium. Accordingly, toners are required to have improved releasability from the recording paper to prevent narrowing of the non-offset temperature range, and one proposed approach involves increasing the content of a release agent in a toner. It is to be noted that a release agent having a narrow molecular weight distribution and a low meting point tends to be unevenly dispersed in a toner, and easily exposes at a surface of the toner.

In contemporary cleaning processes, residual toner particles that remain on a surface of a photoreceptor without being transferred onto a recording medium are collected so that the collected residual toner particles (hereinafter referred to as recycled toner particles) are reused in the developing process. However, the recycled toner particles may be excessively exposed to heat and pressure when transported through a collection path. As a result, a release agent may be exposed at a surface of the recycled toner particle, particularly when the release agent is unevenly dispersed therein. Such a release agent exposed at the surface of the recycled toner particle may form an undesirable film on a photoreceptor or a surface of a carrier, shortening lives thereof. Accordingly, toners have been developed to have both improved releasability and durability.

The colorant is required to be evenly dispersed in the toner. If the colorant is unevenly dispersed therein, not only the resultant image density but also the electric resistance of the toner may be too low. Such a toner may not be efficiently transferred in the transfer process, and as a result, the amount of the recycled toner particles that are excessively exposed to heat and pressure at a collection path increases, resulting in deterioration of the developer.

Methods of manufacturing toner to meet the requirements described above are broadly classified into pulverization methods and polymerization methods. From the viewpoint of cost and ease of color change in continuous manufacturing, pulverization methods are preferable.

A typical pulverization method includes processes of mixing raw materials including a binder resin, a colorant, and a release agent; melt-kneading and cooling the raw material mixture; coarsely and finely pulverizing the kneaded raw material mixture into fine particles; classifying the pulverized fine particles; and adding (adhering) an external additive to the surfaces of the classified fine particles. The dispersion state of the release agent in the resultant toner is controlled in the mixing process. The melt-kneading process is typically performed using an open system roll type kneader, an extruder including a barrel including a screw, or the like. Open system roll type kneaders are widely used recently because the kneading can be performed at a relatively low temperature and a relatively high viscosity.

For example, Japanese Patent No. (hereinafter "JP") 3366576 discloses a method of manufacturing toner using an open system roll type kneader. It is disclosed therein that the open system roll type kneader contributes to improvement of the dispersion state of a wax in the resultant toner, because such an open system roll type kneader is capable of kneading a raw material mixture by applying a high shearing force at low temperatures.

However, there is a possibility of degrading thermal properties of a binder resin when trying to finely disperse both the wax and a colorant therein, because the colorant needs a high shearing force, whereas the release agent needs a low shearing force, to be finely dispersed in the resultant toner. When a high shearing force is applied to the binder resin, molecular chains thereof may be cut, resulting in deterioration of elasticity of the binder resin. Consequently, the resultant toner may easily cause the above-described offset problem at high temperatures, narrowing the non-offset temperature range.

In addition, the release agent may be excessively dispersed and formed into too small particles in the resultant toner when such a high shearing force is applied thereto. Consequently, the resultant toner may have insufficient releasability from a fixing member, narrowing the non-offset temperature range.

Various studies have been made of the mixing process in which raw materials of a toner are mixed.

For example, Unexamined Japanese Patent Application Publication No. (hereinafter "JP-A") 2004-317872 discloses a method of manufacturing toner in which a process for mixing raw materials including a binder resin and a charge control agent is performed under a specific mixing condition.

As another example, JP-A 2005-234370 discloses a method of manufacturing toner in which a process for mixing a charge control agent with a binder resin includes a plurality of steps, so that the charge control agent is finely dispersed in the resultant toner.

Both JP-A 2004-317872 and JP-A 2005-234370 improve the dispersion state of charge control agent in the resultant toner. However, neither of them improves those of release agent and colorant. Accordingly, neither JP-A 2004-317872 nor JP-A 2005-234370 may contribute to improvement of transferability and fixability of the resultant toner.

JP2993624, JP3010326, JP3603709, JP3801458, JP3861978, JP-A 2004-341129, JP-A 2005-345733, JP-A 2006-305982 and JP-A 2007-003799 each disclose a method of manufacturing toner including a first mixing process and a second mixing process, at least one of which is performed using an open system roll type kneader.

These methods have an advantage in that raw materials such as a release agent and a colorant can be finely dispersed in the resultant toner. However, at the same time, molecular chains of a binder resin may be cut in the double mixing processes, resulting in a narrow non-offset temperature range. In a case in which the dispersion state of colorant favored over that of release agent, the release agent may be excessively dispersed and formed into too small particles in the resultant toner. As a consequence, the resultant toner may have insufficient releasability from a fixing member, narrowing the non-offset temperature range. By contrast, in a case in which the dispersion state of release agent favored over that of colorant, the colorant may be insufficiently dispersed in the resultant toner, causing deterioration of the resultant image density and transferability.

SUMMARY OF THE INVENTION

Accordingly, an object of the present invention is to provide a toner in which both a colorant and a release agent are properly dispersed so that the toner has both excellent transferability and fixability, that is, a wide non-offset temperature range.

These and other objects of the present invention, either individually or in combinations thereof, as hereinafter will become more readily apparent can be attained by a method of manufacturing toner, comprising the steps of:

preparing a preliminary mixture by mixing a colorant and a release agent; and preparing a raw material mixture by mixing the preliminary mixture with a binder resin and other raw materials;

melt-kneading the raw material mixture using an open system roll type kneader;

pulverizing the melt-kneaded raw material mixture into fine particles; and classifying the fine particles to prepare a toner; and a toner manufactured by the above method.

BRIEF DESCRIPTION OF THE DRAWING

These and other objects, features and advantages of the present invention will become apparent upon consideration of the following description of the preferred embodiments of the present invention taken in conjunction with the accompanying drawing, wherein:

FIGURE is a block diagram illustrating a method of manufacturing toner according to example embodiments of the present invention.

DETAILED DESCRIPTION OF THE INVENTION

Generally, the present invention provides a method of manufacturing toner, comprising the steps of:

preparing a preliminary mixture by mixing a colorant and a release agent; and preparing a raw material mixture by mixing the preliminary mixture with a binder resin and other raw materials to prepare a raw material mixture;

melt-kneading the raw material mixture using an open system roll type kneader;

pulverizing the melt-kneaded raw material mixture into fine particles; and classifying the fine particles to prepare a toner.

In the above method, raw materials including a colorant, a release agent, a binder resin, and optional other materials are mixed in at least two steps. Specifically, the colorant and the release agent are preliminarily mixed to prepare a preliminary mixture in the first mixing step, and the preliminary mixture is mixed with the binder resin and the optional other materials in the second and succeeding mixing steps to prepare a raw material mixture. The raw material mixture thus prepared is then melt-kneaded using an open system roll type kneader, a kneading part of which has an open system. The raw material mixture thus melt-kneaded is cooled, and then pulverized into fine particles. The fine particles are classified so as to obtain particles having a desired size. Fine particles of inorganic and/or organic materials may be added (adhered) to the surfaces of the desired-sized particles thus classified. FIGURE is a block diagram illustrating a method of manufacturing toner of the present invention.

The first mixing step is intended to evenly adhere the colorant to the surface of the release agent. The release agent, the surface of which is thus covered by the colorant, is melted when the raw material mixture is kneaded, thereby improving the affinity of the surface of the colorant with the binder resin. As a result, the dispersion state of the colorant in the binder resin improves.

Accordingly, the above-described method provides a toner in which a colorant is finely dispersed without application of a high shearing force in the melt-kneading step. In addition, a release agent is also properly dispersed in the toner with an appropriate dispersion diameter. Further, molecular chains of the binder resin are prevented from being cut in the melt-kneading step.

The toner thus manufactured produces high-density images and has a high electric resistance, that is, transferability, because the colorant is finely dispersed therein. In addition, such a toner with high transferability produces less recycled toner particles.

The toner also provides a wide non-offset temperature range because the release agent is properly dispersed in the toner with an appropriate dispersion diameter, and molecular chains of the binder resin are prevented from being cut.

Specific preferred examples of suitable mixers for use in the mixing step include, but are not limited to, HENSHEL MIXER (from Mitsui Mining Co., Ltd.).

Specific preferred examples of suitable open system roll type kneaders for use in the melt-kneading step include, but are not limited to, double roll type kneaders and triple roll type kneaders. From the viewpoint of manufacturability, continuous double roll type kneaders are preferable.

Specific preferred examples of suitable pulverizers for use in the pulverizing step include, but are not limited to, counter jet mills and I-type jet mills.

Specific preferred examples of suitable classifiers for use in the classifying step include, but are not limited to, rotary classifiers and airflow classifiers.

The toner of the present invention is manufactured as follows, for example. First, a colorant and a release agent are mixed using a HENSHEL MIXER to prepare a preliminary mixture in the first mixing step, and the preliminary mixture is then mixed with a binder resin and optional other materials in the second mixing step to prepare a raw material mixture.

The raw material mixture thus prepared is then melt-kneaded using an open system roll type kneader such as a continuous double roll kneader. Since the kneading part of the roll type kneader has an open system, the melt-kneaded mixture is easily air-cooled and suppressed from being heated. In other words, the viscosity of the melt-kneaded mixture is prevented from decreasing. Accordingly, a shearing force can be easily applied to the melt-kneaded mixture, and therefore toner components such as the colorant and the release agent are evenly dispersed therein at a relatively low temperature and a relatively high viscosity. The kneading temperature and time are set as appropriate according to the properties of the raw materials, so that the release agent is not excessively dispersed and molecular chains of the binder resins are not cut.

Subsequently, the melt-kneaded mixture is cooled, and then pulverized into fine particles using a pulverizer such as a counter jet mill. The fine particles are classified using a classifier such as a rotary classifier to obtain particles having a desired particle diameter of 3 to 15 μm, for example. Fine particles of inorganic and/or organic materials may be added (adhered) to the surfaces of the desired-sized particles thus classified. Thus, a toner of the present invention is obtained.

Next, suitable raw materials for the present invention will be described in detail.

As the release agent, natural waxes and synthetic waxes can be used.

Specific preferred examples of suitable natural waxes include, but are not limited to, animal waxes such as beeswax, spermaceti wax, and shellac wax; plant waxes such as carnauba wax, sumac wax, rice wax, and candelilla wax; petroleum waxes such as paraffin wax and microcrystalline wax; and mineral waxes such as montan wax and ozokerite. Specific preferred examples of suitable synthetic waxes include, but are not limited to, Fisher-Tropsch wax, polyethylene wax, fat waxes (e.g., esters, ketones, amides), and hydrogenated wax.

A suitable wax preferably has an endothermic peak within a temperature range of from 80 to 110° C. when measured by a differential scanning calorimeter (DSC). The measurement is preformed according to JIS-K 7122-1987. A temperature at which the endothermic peak is observed is regarded as the melting point.

Specifically, synthetic hydrocarbon waxes and petroleum waxes are preferable. The synthetic hydrocarbon waxes are broadly classified into Fisher-Tropsch wax obtainable by reacting carbon monoxide with hydrogen, and polyethylene wax obtainable by polymerization of ethylene or thermal decomposition of polyethylene.

A suitable wax preferably has a polarity, and more preferably has an acid value of from 3 to 8 mgKOH/g. A wax with a polarity is obtainable by subjecting a raw material wax to a chemical or physical processing or modification.

Modified waxes are broadly classified into oxidized waxes and blended waxes in which synthetic resins are blended. An oxidized wax is obtainable by oxidizing a raw material wax using an agent or oxygen in the air. A blended wax is obtainable by blending synthetic resins (such as ethylene-vinyl acetate copolymer, polyethylene, and synthetic rosin) having good affinity with each other so as to enhance mechanical strength.

Further, a suitable release agent preferably has a penetration of 5 mm or less. The penetration is measured according to JIS K-2235-5.4 that specifies a method of measuring hardness of release agent. Specifically, 100 g of a load is applied to a penetrator of a penetrometer under a specified temperature, and the penetrator is then penetrated into a sample for 5 seconds. A distance (mm) the penetrator penetrated into the sample is measured and penetration determined by multiplying the measured distance by 10.

The penetration thus determined represents the softness of release agent. Since the release agent by nature easily exposes at the surface of a toner, a film of the release agent is easily formed on a photoreceptor or a carrier. When the penetration is greater than 5 mm, it means the release agent is soft. In this case, a film of the release agent is more easily formed on a photoreceptor or a carrier.

A suitable release agent preferably has a weight average particle diameter of from 5 to 100 μm. When the weight average particle diameter is too small, the release agent may be dispersed in the resultant toner with too small a dispersion diameter, thereby narrowing the non-offset temperature range. By contrast, when the weight average particle diameter is too large, the release agent may be dispersed in the resultant toner with too large a dispersion diameter, degrading recycled toner particles. Consequently, a photoreceptor and a developer easily deteriorate.

The raw materials preferably include the release agent in an amount of from 3.0 to 8.0% by weight based on the total weight of the raw material. When the amount is too small, the release agent cannot sufficiently exude from the toner, and therefore the non-offset temperature range is narrowed. By contrast, when the amount is too large, too large an amount of the release agent exposes at the surface of the toner, degrading recycled toner particles. Consequently, a photoreceptor and a developer easily deteriorate.

Any known colorants of yellow, magenta, cyan, and black colors can be used as the colorant.

Specific preferred examples of suitable yellow colorants include, but are not limited to, azo pigments such as C. I. Pigment Yellow 1, C. I. Pigment Yellow 5, C. I. Pigment Yellow 12, C. I. Pigment Yellow 15, and C. I. Pigment Yellow 17; inorganic pigments such as yellow iron oxide and loess; nitro dyes such as C. I. Acid Yellow 1; and oil-soluble dyes such as C. I. Solvent Yellow 2, C. I. Solvent Yellow 6, C. I. Solvent Yellow 14, C. I. Solvent Yellow 15, C. I. Solvent Yellow 19, and C. I. Solvent Yellow 21. From the viewpoint of color tone, benzidine pigments such as C. I. Pigment Yellow 17 are preferable.

Specific preferred examples of suitable magenta colorants include, but are not limited to, C. I. Pigment Red 49, C. I. Pigment Red 57, C. I. Pigment Red 81, C. I. Pigment Red 122, C. I. Solvent Red 19, C. I. Solvent Red 49, C. I. Solvent Red 52, C. I. Basic Red 10, and C. I. Disperse Red 15. From the viewpoint of color tone, quinacridone pigments such as C. I. Pigment Red 122 are preferable.

Specific preferred examples of suitable cyan colorants include, but are not limited to, C. I. Pigment Blue 15, C. I. Pigment Blue 16, C. I. Solvent Blue 55, C. I. Solvent Blue 70, C. I. Direct Blue 25, and C. I. Direct Blue 86. From the viewpoint of color tone, copper phthalocyanine pigments such as C. I. Pigment Blue 15 are preferable.

Specific preferred examples of suitable black colorants include, but are not limited to, carbon blacks such as channel black, channel black, gas furnace black, oil furnace black, and acetylene black.

Specific preferred examples of suitable binder resins include, but are not limited to, styrene resins, i.e., homopolymers and copolymers of styrene or styrene derivatives (e.g., polystyrene, poly-α-methylstyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylate copolymer, styrene-methacrylate copolymer, styrene-methyl α-chloroacrylate copolymer, styrene-acrylonitrile-acrylate copolymer), epoxy resins, vinyl chloride resins, rosin-modified maleic acid resins, phenol resins, polyethylene resins, polypropylene resins, petroleum resins, polyurethane resins, ketone resins, ethylene-ethyl acrylate copolymer, xylene resins, and polyvinyl butyrate resins. These resins can be manufactured by a known method such as a mass polymerization, a solution polymerization, an emulsion polymerization, or a suspension polymerization.

The binder resin preferably includes a polyester resin that is fixable at lower temperatures compared to other resins, while keeping thermostable preservability.

A polyester resin is obtained from a polycondensation of an alcohol with a carboxylic acid.

Specific examples of usable alcohols include, but are not limited to, glycols such as ethylene glycol, diethylene glycol, triethylene glycol, and propylene glycol; etherified bisphenols such as 1,4-bis(hydroxymethyl)cyclohexane and bisphenol A; diols; and polyols having 3 or more valences.

Specific examples of usable carboxylic acids include, but are not limited to, divalent organic acids such as maleic acid, fumaric acid, phthalic acid, isophthalic acid, terephthalic acid, succinic acid, and malonic acid; and polycarboxylic acids having 3 or more valences such as 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, and 1,2,7,8-octanetetracarboxylic acid.

The polyester resin preferably has a glass transition temperature (Tg) of from 58 to 75° C.

The raw materials may optionally include a charge control agent for the purpose of controlling triboelectric chargeability of the toner. Charge control agents include positive charge control agents and negative charge control agents.

Specific preferred examples of suitable positive charge control agents include, but are not limited to, organic compounds having a basic nitrogen atom, such as basic dyes, quaternary ammonium salts, aminopyrine compounds, pyrimidine compounds, polynuclear polyamino compounds, aminosilane, and nigrosine base.

Specific preferred examples of suitable negative charge control agents include, but are not limited to, oil-soluble dyes such as oil black and spilon black, metal-containing azo dyes, metal salts of naphthenic acid, metal salts of alkyl salicylic acids, soaps of fatty acids, and soaps of resins acids.

The toner preferably includes the charge control agent in an amount of from 0.1 to 10 parts by weight, more preferably from 0.5 to 8 parts by weight, based on 100 parts by weight of the binder resin. Colorless charge control agents such as quaternary ammonium salts and metal salts of alkyl salicylic acids are preferable for full-color toners.

As described above, fine particles of inorganic and/or organic materials may be added (adhered) to the surfaces of the desired-sized toner particles. Specific preferred examples of suitable inorganic materials include, but are not limited to, metal salts of fatty acids, zinc stearate, calcium stearate, lead stearate, zinc oxide, aluminum oxide, titanium oxide, and silica. Specific preferred examples of suitable organic materials include, but are not limited to, melamine resins.

The toner of the present invention preferably has a weight average particle diameter of from 3 to 15 μm, more preferably 9 μm or less, and much more preferably from 4 to 8 μm, in order to produce high quality images.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

In the following examples, a polyester resin (1) and a polyester resin (2) previously prepared are used as binder resins.

The polyester resin (1) is manufactured from fumaric acid, polyoxypropylene-(2.2)-2,2-bis(4-hydroxyphenyl)propane, polyoxyethylene-(2.3)-2,2-bis(4-hydroxyphenyl)propane, and trimellitic anhydride, and has an acid value of 10 mgKOH/g, a hydroxyl value of 30 mgKOH/g, a number average molecular weight (Mn) of 10,000, a ratio (Mw/Mn) of the weight average molecular weight (Mw) to the Mn of 10, a peak molecular weight of 12,000, a glass transition temperature (Tg) of 68° C., and a softening point of 138° C.

The polyester resin (2) is manufactured from fumaric acid, polyoxypropylene-(2.2)-2,2-bis(4-hydroxyphenyl)propane, polyoxyethylene-(2.3)-2,2-bis(4-hydroxyphenyl)propane, and trimellitic anhydride, and has an acid value of 35 mgKOH/g, a hydroxyl value of 50 mgKOH/g, a number average molecular weight (Mn) of 8,500, a ratio (Mw/Mn) of the weight average molecular weight (Mw) to the Mn of 8, a peak molecular weight of 98,000, a glass transition temperature (Tg) of 60° C., and a softening point of 125° C.

Example 1

First, 10 parts of a carnauba wax (having an acid value of 2.5 mgKOH/g, a melting point of 87.5° C., a weight average particle diameter of 4 μm, and a penetration of 5 mm) and 10 parts of a carbon black (#44 from Mitsubishi Chemical Corporation) are evenly mixed using a HENSCHEL MIXER (i.e., the first mixing step).

Next, 78 parts of the polyester resin (1) and 2 parts of a charge control agent (BONTRON® S-34 from Orient Chemical Industries, Ltd.) are further added thereto and evenly mixed therewith (i.e., the second mixing step).

The mixture thus prepared is melt-kneaded using an open system roll type kneader (a continuous double roll kneader KNEADEX MOS 160-560 from Mitsui Mining Co., Ltd.). The kneading conditions are as follows.

(1) Kneading Temperatures
Front roll supply side: 90° C.
Front roll discharge side: 50° C.
Rear roll supply side: 20° C.
Rear roll discharge side: 20° C.
(2) Gap Between Rolls
Supply side: 0.5 mm
Discharge side: 0.5 mm
(3) Rotation Number of Rolls
Front roll: 50 rpm
Rear roll: 40 rpm
(4) Supply Speed: 5.0 kg/h The mixture thus kneaded is then finely pulverized into fine particles using a counter jet mill. The fine particles of the mixture thus pulverized are then subjected to classification using a rotary classifier so that excessively-pulverized particles are removed and toner particles having a weight average particle diameter of 7.5 μm are obtained. The toner particles thus classified are further mixed with 1.0 part of fine particles of a hydrophobized colloidal silica, serving as a fluidizer, having a number average particle diameter of 12 nm. Thus, a toner (1) is prepared.

Example 2

First, 2.5 parts of a carnauba wax (having an acid value of 2.5 mgKOH/g, a melting point of 87.5° C., a weight average particle diameter of 350 μm, and a penetration of 5 mm) and 10 parts of a carbon black (#44 from Mitsubishi Chemical Corporation) are evenly mixed using a HENSCHEL MIXER (i.e., the first mixing step).

Next, 85.5 parts of the polyester resin (1) and 2 parts of a charge control agent (BONTRON® S-34 from Orient Chemical Industries, Ltd.) are further added thereto and evenly mixed therewith (i.e., the second mixing step).

The mixture thus prepared is melt-kneaded using an open system roll type kneader under the same conditions as Example 1. The mixture thus kneaded is then finely pulverized into fine particles using a counter jet mill. The fine particles of the mixture thus pulverized are then subjected to classification using a rotary classifier so that excessively-pulverized particles are removed and toner particles having a weight average particle diameter of 7.5 μm are obtained. The toner particles thus classified are further mixed with 1.0 part of fine particles of a hydrophobized colloidal silica, serving as a fluidizer, having a number average particle diameter of 12 nm. Thus, a toner (2) is prepared.

Example 3

First, 9 parts of a carnauba wax (having an acid value of 3.5 mgKOH/g, a melting point of 85.5° C., a weight average particle diameter of 6.0 μm, and a penetration of 6 mm) and 10 parts of a carbon black (#44 from Mitsubishi Chemical Corporation) are evenly mixed using a HENSCHEL MIXER (i.e., the first mixing step).

Next, 79 parts of the polyester resin (1) and 2 parts of a charge control agent (BONTRON® S-34 from Orient Chemical Industries, Ltd.) are further added thereto and evenly mixed therewith (i.e., the second mixing step).

The mixture thus prepared is melt-kneaded using an open system roll type kneader under the same conditions as Example 1. The mixture thus kneaded is then finely pulverized into fine particles using a counter jet mill. The fine particles of the mixture thus pulverized are then subjected to classification using a rotary classifier so that excessively-pulverized particles are removed and toner particles having a weight average particle diameter of 6.0 μm are obtained. The toner particles thus classified are further mixed with 1.5 parts of fine particles of a hydrophobized colloidal silica, serving as a fluidizer, having a number average particle diameter of 12 nm. Thus, a toner (3) is prepared.

Example 4

First, 2.5 parts of a carnauba wax (having an acid value of 4.5 mgKOH/g, a melting point of 86.5° C., a weight average particle diameter of 95 μm, and a penetration of 5 mm) and 10 parts of a carbon black (#44 from Mitsubishi Chemical Corporation) are evenly mixed using a HENSCHEL MIXER (i.e., the first mixing step).

Next, 85.5 parts of the polyester resin (1) and 2 parts of a charge control agent (BONTRON® S-34 from Orient Chemical Industries, Ltd.) are further added thereto and evenly mixed therewith (i.e., the second mixing step).

The mixture thus prepared is melt-kneaded using an open system roll type kneader under the same conditions as Example 1. The mixture thus kneaded is then finely pulverized into fine particles using a counter jet mill. The fine particles of the mixture thus pulverized are then subjected to classification using a rotary classifier so that excessively-pulverized particles are removed and toner particles having a weight average particle diameter of 6.0 μm are obtained. The toner particles thus classified are further mixed with 1.2 parts of fine particles of a hydrophobized colloidal silica, serving as a fluidizer, having a number average particle diameter of 12 nm. Thus, a toner (4) is prepared.

Example 5

First, 4 parts of a carnauba/rice wax (having an acid value of 5.5 mgKOH/g, a melting point of 82.4° C., a weight average particle diameter of 55 μm, and a penetration of 5 mm) and 10 parts of a carbon black (#44 from Mitsubishi Chemical Corporation) are evenly mixed using a HENSCHEL MIXER (i.e., the first mixing step).

Next, 84 parts of the polyester resin (2) and 2 parts of a charge control agent (BONTRON® S-34 from Orient Chemical Industries, Ltd.) are further added thereto and evenly mixed therewith (i.e., the second mixing step).

The mixture thus prepared is melt-kneaded using an open system roll type kneader under the same conditions as Example 1. The mixture thus kneaded is then finely pulverized into fine particles using a counter jet mill. The fine particles of the mixture thus pulverized are then subjected to classification using a rotary classifier so that excessively-pulverized particles are removed and toner particles having a weight average particle diameter of 5.0 μm are obtained. The toner particles thus classified are further mixed with 1.3 parts of fine particles of a hydrophobized colloidal silica, serving as a fluidizer, having a number average particle diameter of 12 nm. Thus, a toner (5) is prepared.

Example 6

First, 7 parts of a carnauba/rice wax (having an acid value of 5.5 mgKOH/g, a melting point of 82.4° C., a weight average particle diameter of 55 μm, and a penetration of 5 mm) and 10 parts of a magenta pigment KET RED 309 from DIC Corporation) are evenly mixed using a HENSCHEL MIXER (i.e., the first mixing step).

Next, 81 parts of the polyester resin (2) and 2 parts of a charge control agent (BONTRON® S-34 from Orient Chemical Industries, Ltd.) are further added thereto and evenly mixed therewith (i.e., the second mixing step).

The mixture thus prepared is melt-kneaded using an open system roll type kneader under the same conditions as Example 1. The mixture thus kneaded is then finely pulverized into fine particles using a counter jet mill. The fine particles of the mixture thus pulverized are then subjected to classification using a rotary classifier so that excessively-pulverized particles are removed and toner particles having a weight average particle diameter of 5.0 μm are obtained. The toner particles thus classified are further mixed with 1.5 parts of fine particles of a hydrophobized colloidal silica, serving as a fluidizer, having a number average particle diameter of 12 nm. Thus, a toner (6) is prepared.

Example 7

First, 5 parts of a carnauba/rice wax (having an acid value of 3.5 mgKOH/g, a melting point of 80.3° C., a weight average particle diameter of 85 μm, and a penetration of 2 mm) and 10 parts of a magenta pigment KET RED 309 from DIC Corporation) are evenly mixed using a HENSCHEL MIXER (i.e., the first mixing step).

Next, 83 parts of the polyester resin (2) and 2 parts of a charge control agent (BONTRON® S-34 from Orient Chemical Industries, Ltd.) are further added thereto and evenly mixed therewith (i.e., the second mixing step).

The mixture thus prepared is melt-kneaded using an open system roll type kneader under the same conditions as Example 1. The mixture thus kneaded is then finely pulverized into fine particles using a counter jet mill. The fine particles of the mixture thus pulverized are then subjected to classification using a rotary classifier so that excessively-pulverized particles are removed and toner particles having a weight average particle diameter of 5.5 μm are obtained. The toner particles thus classified are further mixed with 1.4 parts of fine particles of a hydrophobized colloidal silica, serving as a fluidizer, having a number average particle diameter of 12 nm. Thus, a toner (7) is prepared.

Comparative Example

First, 10 parts of a carnauba wax (having an acid value of 2.5 mgKOH/g, a melting point of 87.5° C., a weight average particle diameter of 4 μm, and a penetration of 5 mm), 10 parts of a carbon black (#44 from Mitsubishi Chemical Corporation), 78 parts of the polyester resin (1), and 2 parts of a charge control agent (BONTRON® S-34 from Orient Chemical Industries, Ltd.) are evenly mixed using a HENSCHEL MIXER.

The mixture thus prepared is melt-kneaded using an open system roll type kneader under the same conditions as Example 1. The mixture thus kneaded is then finely pulverized into fine particles using a counter jet mill. The fine particles of the mixture thus pulverized are then subjected to classification using a rotary classifier so that excessively-pulverized particles are removed and toner particles having a weight average particle diameter of 7.5 μm are obtained. The toner particles thus classified are further mixed with 1.0 parts of fine particles of a hydrophobized colloidal silica, serving as a fluidizer, having a number average particle diameter of 12 nm. Thus, a toner (8) is prepared.

Evaluations

The above-prepared toners (1) to (8) are subjected to the following evaluations (a) to (e). The evaluation results are shown in Table 1.

(a) Minimum Fixable Temperature

To prepare two-component developers, 5 parts of each of the toners (1) to (8) is evenly mixed with 95 parts of a silicone-coated carrier. Each of the two-component developers thus prepared is set in a commercially available copier (IMAGIO NEO 450 from Ricoh Co., Ltd.), and an unfixed toner image is produced on sheets of paper. On the other hand, the fixing unit of the copier (IMAGIO NEO 450 from Ricoh Co., Ltd.) is modified so that the temperature of the heat roller is variable. Each of the sheets having an unfixed toner image is fixed using the modified fixing unit at a linear speed of 230 mm/sec varying the temperature of the heat roller.

The minimum fixable temperature is defined as a temperature below which the residual rate of image density of the fixed toner image after being rubbed by a pad is less than 70%.

(b) Hot Offset Temperature

Similar to the evaluation of the minimum fixable temperature described above, each of the sheets having an unfixed toner image is fixed using the modified fixing unit at a linear speed of 230 mm/sec varying the temperature of the heat roller, and the fixed toner images are visually observed.

The hot offset temperature is defined as a temperature at and above which an offset problem occurs. The offset problem here refers to an undesirable phenomenon in which part of a fused toner image is adhered to the surface of the heat roller, and re-transferred onto an undesired portion of the sheet of paper.

(c) Electric Resistivity

The electric resistivity of a toner, which indicates the dispersion state of a colorant in the toner, such that the higher the resistivity, the better the colorant dispersibility, is measured under the following conditions.

Measuring instrument: a dielectric loss measuring device TR-1100 (from Ando Electronic Co., Ltd.)

Electrode: a powder electrode SE-43 (from Ando Electronic Co., Ltd.)

Frequency: 1 kHz (d) Formation of Film on Photoreceptor

The two-component developers prepared above are exposed to a high-temperature and high-humidity condition of 30° C. and 85% RH for 2 hours or more. Each of the two-component developers is set in a commercially available copier (IMAGIO NEO 450 from Ricoh Co., Ltd., equipped with a recycle mechanism), and images are produced on 50,000 sheets of paper. Thereafter, the photoreceptor is visually observed to determine whether or not an undesirable film of the toner or toner components is formed thereon. At the same time, the produced images are visually observed to evaluate image quality. The evaluation results are graded as follows.

A: No film is formed on the photoreceptor, and the image quality is good.

B: A film is slightly formed on the photoreceptor, but the image density decreases only slightly.

C: A film is slightly formed on the photoreceptor, and the image density decreases.

D: A film is formed on the photoreceptor, and the image quality deteriorates.

Typically, as the dispersibility of the release agent deteriorates, an undesirable film more easily formed on the photoreceptor.

(e) Propensity to Wear Down Carrier

When the above-described two-component developer has produced images on 50,000 sheets of paper, it is subjected to a blow off treatment so that the toner is removed and the carrier is collected. The carrier thus collected is immersed in a solvent to remove substances adhered to the surface of the carrier. The propensity (%) of the toner to wear down the carrier is represented by the following equation:

$$(W1-W2)/W1\times100(\%)$$

wherein W1 represents the weight of the carrier after being collected from the developer, and W2 represents the weight of the carrier after being immersed in a solvent followed by drying.

Typically, as the dispersibility of the release agent deteriorates, the propensity of the toner to wear down the carrier increases.

The results of the evaluations are shown in Table 1.

TABLE 1

| | (a) | (b) | (c) | (d) | (e) |
|---|---|---|---|---|---|
| Example 1 | 150 | 240 | $1.00\times10^{11}$ | B | 0.058 |
| Example 2 | 155 | 210 | $1.20\times10^{11}$ | A | 0.036 |

TABLE 1-continued

| | (a) | (b) | (c) | (d) | (e) |
|---|---|---|---|---|---|
| Example 3 | 145 | 240 | $1.30 \times 10^{11}$ | B | 0.047 |
| Example 4 | 155 | 230 | $1.30 \times 10^{11}$ | A | 0.026 |
| Example 5 | 140 | 235 | $1.30 \times 10^{11}$ | A | 0.035 |
| Example 6 | 140 | 240 | $1.40 \times 10^{11}$ | A | 0.041 |
| Example 7 | 140 | 240 | $1.50 \times 10^{11}$ | A | 0.034 |
| Comparative Example | 150 | 225 | $8.90 \times 10^{10}$ | D | 0.125 |

(a) Minimum Fixable Temperature (° C.)
(b) Hot Offset Temperature (° C.)
(c) Electric Resistivity (Ω · cm)
(d) Formation of Film on Photoreceptor (Rank)
(e) Propensity to Wear Down Carrier (%)

It is apparent from Table 1 that the toners of Examples 1 to 7 manufactured by the method of the present invention show good results in all the evaluations (a) to (e), because the colorant and the release agent are properly dispersed in the toner. By contrast, the toner of the Comparative Example shows poor results particularly in the evaluations (d) and (e), possibly having problems in transferability and fixability.

This document claims priority and contains subject matter related to Japanese Patent Application No. 2007-322859, filed on Dec. 14, 2008, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A method of manufacturing toner, comprising the steps of:

preparing a preliminary mixture by mixing a colorant and a release agent, wherein the release agent has a weight average particle diameter of from 5 to 100 μm; and preparing a raw material mixture by mixing the preliminary mixture with a binder resin and other raw materials;

melt-kneading the raw material mixture using an open system roll kneader;

pulverizing the melt-kneaded raw material mixture into fine particles; and classifying the fine particles to prepare a toner.

2. The method of manufacturing toner according to claim 1, wherein the release agent comprises an amount of from 3.0 to 8.0% by weight based on a total weight of the raw materials.

* * * * *